US005320131A

United States Patent [19]

Dull

[11] Patent Number: 5,320,131

[45] Date of Patent: Jun. 14, 1994

[54] METHOD OF PROVIDING AN AROMA AND FLAVOR PRECURSOR FOR SMOKING ARTICLES

[75] Inventor: Gary M. Dull, Lewisville, N.C.

[73] Assignee: R. J. Reynolds Tobacco Company, Winston-Salem, N.C.

[21] Appl. No.: 914,901

[22] Filed: Jul. 16, 1992

[51] Int. Cl.[5] ..... A24D 1/02

[52] U.S. Cl. ..... 131/365; 568/592

[58] Field of Search ..... 131/365; 426/533, 534; 568/592

[56] References Cited

U.S. PATENT DOCUMENTS

| | | | |
|---|---|---|---|
| 3,047,432 | 7/1962 | Bavley et al. . | |
| 3,047,433 | 7/1962 | Bavley et al. . | |
| 3,857,964 | 12/1974 | Yolles | 426/3 |
| 3,886,297 | 5/1975 | Parliment et al. . | |
| 4,306,577 | 12/1981 | Wu et al. . | |
| 4,470,421 | 9/1984 | Southwick et al. . | |
| 4,538,627 | 9/1985 | Chan et al. . | |
| 4,538,628 | 9/1985 | Podraza . | |
| 4,540,004 | 9/1985 | Podraza et al. . | |
| 4,578,486 | 3/1986 | Podraza . | |
| 4,635,652 | 1/1987 | Houminer et al. . | |
| 4,638,816 | 1/1987 | Cox et al. . | |
| 4,804,002 | 2/1989 | Herron . | |
| 4,941,486 | 7/1990 | Dube et al. . | |
| 4,956,481 | 9/1990 | Gillaspey et al. . | |
| 5,139,793 | 8/1992 | Johnson et al. | 426/3 |

FOREIGN PATENT DOCUMENTS

| | | |
|---|---|---|
| 0413162A2 | 7/1990 | European Pat. Off. . |
| 0501645A1 | 9/1992 | European Pat. Off. . |
| 1-128993 | 5/1989 | Japan . |
| WO9210107 | 12/1991 | PCT Int'l Appl. . |

*Primary Examiner*—José G. Dees
*Assistant Examiner*—Samuel Barts
*Attorney, Agent, or Firm*—Grover M. Myers

[57] ABSTRACT

The present invention relates to a method of providing an aromatic and flavorful precursor for use in a smoking article to alter the aroma of mainstream and sidestream smoke upon burning the cigarette during use. In particular, 2,3-pinanediol and transcinnamaldehyde are contacted together, preferably in the presence of an acid catalyst. The resulting aromatic and flavorful precursor is then collected.

1 Claim, 1 Drawing Sheet

METHOD OF PROVIDING AN AROMA AND FLAVOR PRECURSOR FOR SMOKING ARTICLES

BACKGROUND OF THE INVENTION

The present invention relates to smoking articles such as cigarettes, and in particular to the synthesis of a precursor for altering the aroma and flavor characteristics of the mainstream and sidestream smoke of smoking articles.

Popular smoking articles, such as cigarettes, have a substantially rod shaped structure and include a charge of smokable material such as strands or shreds of tobacco (e.g., cut filler) surrounded by a paper wrapper thereby providing a so-called "tobacco rod." Numerous popular cigarettes have cylindrical filter elements aligned in an end-to-end relationship with the tobacco rod. Typically, filter elements are constructed from fibrous materials such as cellulose acetate, have a circumscribing plug wrap, and are attached to the tobacco rod using tipping material.

Cigarettes are employed by the smoker by burning one end thereof. The smoker then receives mainstream smoke into his/her mouth by drawing on the opposite end (e.g., filter end) of the cigarette. Typically, a person using a cigarette draws on or puffs the article about 5 to about 10 times, and each puff lasts about 0.5 second to about 2 seconds. Typically, a burning cigarette has a useful lifetime of about 1 minute to about 10 minutes. During the time that the cigarette is not being drawn upon by the smoker, it remains burning and sidestream smoke can be generated. Sidestream smoke is smoke which directly enters and diffuses into the atmosphere during the burning of a smoking article. The characteristic sight and odor of the mainstream smoke and the sidestream smoke may be perceived negatively by certain individuals.

There are several general approaches to altering the characteristic sight and odor of mainstream and sidestream smoke. One is to reduce the amount of sidestream smoke such as described, for example in U.S. Pat. Nos. 3,744,496 to McCarty, 4,231,377 and 4,420,002 both to Cline and 4,561,454 to Guess. Typically, this is accomplished by reducing the amount of tobacco consumed during the smolder period between puffs, or by reducing the amount of smoke generated during combustion. Another approach is to alter the aroma of the sidestream smoke such as described, for example in U.S. Pat. Nos. 4,941,486 to Dube et al. and 4,804,002 to Herron.

It would be highly desirable to provide a method of forming an aromatic and flavorful precursor useful in a smoking article and components thereof which prior to being employed by the user is odorless, and when employed provides highly pleasant smelling sidestream smoke and which delivers good tobacco taste to the smoker.

SUMMARY OF THE INVENTION

The present invention relates to a method of providing an aromatic and flavorful precursor for use in a smoking article to alter the aroma of mainstream and sidestream smoke upon burning the cigarette during use. In particular, a nonglycosidic diol and a ketone or aldehyde flavoring agent are contacted together, preferably in the presence of an acid catalyst (e.g., p-toluenesulfonic acid). A nonglycosidic acetal aromatic and flavorful precursor is formed and then collected. As used herein, the term "nonglycosidic diol" relates to a compound having diol functionality and not having the structure of a sugar.

The aromatic and flavorful precursor can be used with various components of smoking articles. For example, cigarettes have a charge of smokable (e.g., tobacco) material contained in circumscribing wrapping material. The smokable material and/or the wrapping material can have in intimate contact therewith the aromatic and flavorful precursor. The aromatic and flavorful precursor is used in an amount sufficient to provide an alteration in flavor and aroma of the mainstream smoke and the aroma of the sidestream smoke of the cigarette upon burning during use. This results in substantially less perceivable aroma characteristics to the mainstream smoke of the cigarette than to the sidestream smoke during use thereof. Such characteristics are provided due to the nature of the aromatic and flavorful precursor and the selected position of placement of the precursor within the smoking article. The aromatic and flavorful precursor provides essentially no perceivable aroma characteristics to the cigarette prior to use thereof (i.e., prior to the smoking period).

As used herein, the term "precursor" relates to a composition which exhibits little or no flavor or aroma characteristics, but which experiences a change in its chemical composition when subjected to the application of heat such as is experienced in a burning cigarette.

The present invention allows the smoker to enjoy good tobacco taste upon smoking the smoking article (e.g., a cigarette) while using a smoking article which can provide what can be perceived as highly pleasant smelling sidestream smoke. In particular, the aroma provided by the chemical rearrangement of the aromatic and flavorful precursor during the use of the smoking article can be such so as to override the odor of the ensuing sidestream smoke, and thereby suppress the odor thereof. Of particular interest are smoking articles which provide highly pleasant smelling sidestream smoke but which provide the substantially unaltered characteristic tobacco smoke taste to the user. In particular, the taste of the mainstream smoke is complemented or not adversely affected by the compounds provided by the rearrangement of the aromatic and flavorful precursor. For example, the flavor characteristics provided to the mainstream smoke by the aromatic and flavorful compounds are not so overpowering so as to deleteriously affect or otherwise provide undesirable off-tastes to the mainstream smoke.

DETAILED DESCRIPTION OF THE PREFERRED EMBODIMENTS

Figure 1:
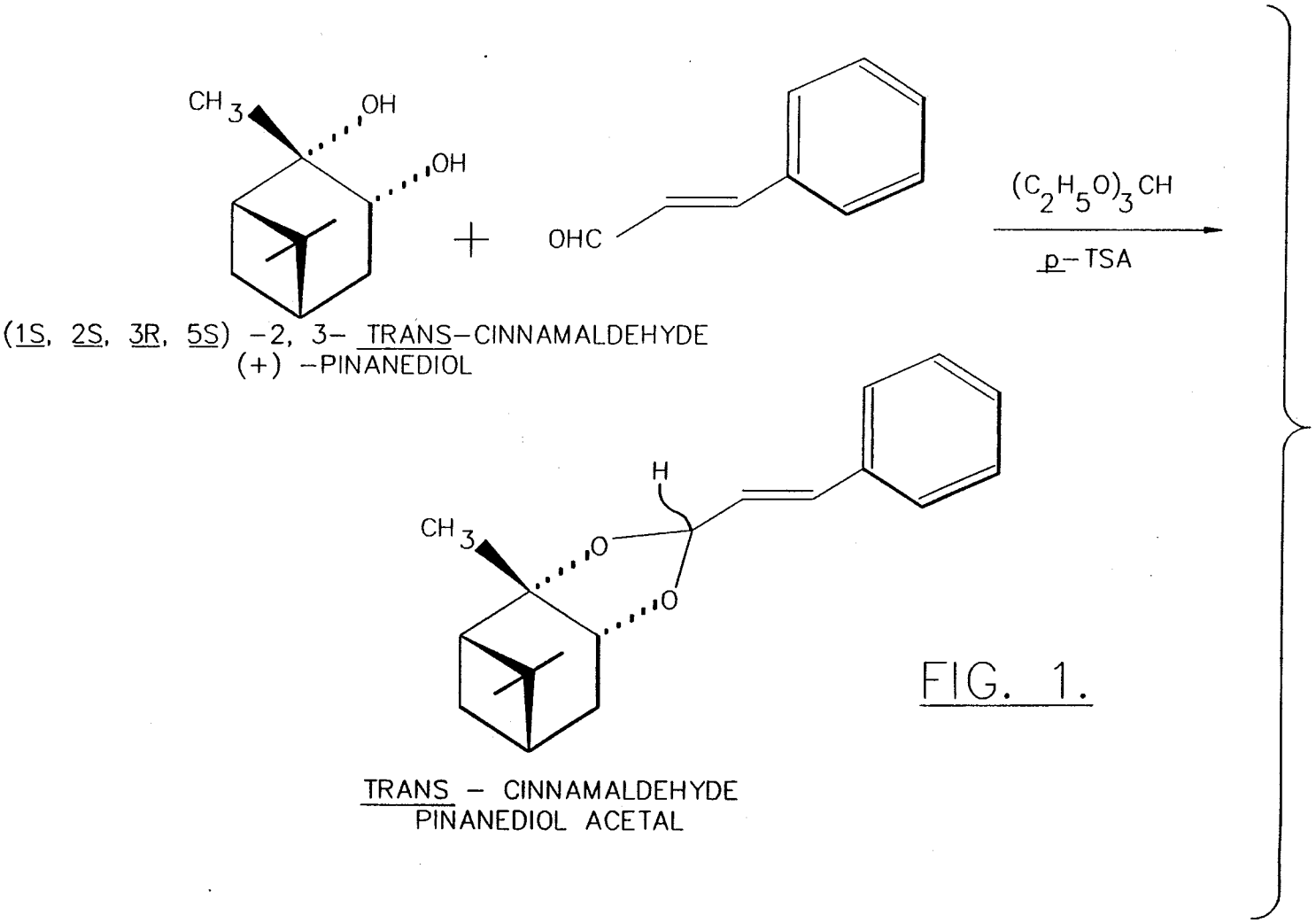
FIG. 1 depicts a reaction scheme for the synthesis of a flavorful and aromatic compound according to the present invention.

As summarized above, the method of the present invention includes contacting a nonglycosidic diol and a ketone or aldehyde flavoring agent preferably in the presence of an acid catalyst. Suitable nonglycosidic diols include diethyl tartrate, 2,2-dimethyl-1,3-propanediol, 2,3-pinanediol, dimethyl tartrate and 2,3-butanediol. Other suitable diols include glycols such as glycerol and propylene glycol.

Suitable ketones include acetophenone, 3-octanone, 1-menthone, acetanisole, and d-camphor, and derivatives thereof. Suitable aldehydes include 4-hydroxy-3-methoxybenzaldehyde (vanillin), 4-hydroxy-3-ethoxybenzaldehyde (ethyl vanillin), 3,4-(methylenedioxy)-benzaldehyde (piperonal), anisic aldehyde, trans-cinnamaldehyde (cinnamic aldehyde) tolualdehyde, benzaldehyde, isobutyraldehyde and derivatives thereof. Other suitable aldehydes and ketones are described in Leffingwell et al. *Tobacco Flavoring For Smoking Products,* 1972, pages 19–22 and 38–44.

The nonglycosidic diol and the ketone or aldehyde flavoring agent can be contacted together using any reaction technique known to those skilled in the art. For example, FIG. 1 depicts a reaction scheme for forming an exemplary aromatic and flavorful precursor. A nonglycosidic diol (i.e., 2,3-pinanediol) and an aldehyde (i.e., trans-cinnamaldehyde) are condensed in the presence of an acid catalyst and optionally triethyl orthoformate or other dehydrating agent. Exemplary acid catalysts are catalysts having a $pK_a$ at 25° C. of less than 6, sometimes have a $pk_a$ at 25° C. of less than 4, and often have a $pK_a$ at 25° C. of less than 3. Preferably, the acid catalyst has a $pK_a$ at 25° C. in the range from about 2 to about 5. An exemplary acid catalyst is p-toluenesulfonic acid. The catalyst can also be a cationic exchange resin such a Bio-REX® or Dowex® 50 available from Bio-Rad, Co. of Richmond, Calif. or Amberlyst® 15 from Rohm and Haas, Inc. of Philadelphia, Pa.

The resulting aromatic and flavorful precursor is collected using conventional techniques such known to those skilled in the art. Exemplary techniques include liquid-liquid extraction, high vacuum distillation (preferably below 100° C.), steam distillation and chromatography (e.g., flash-chromatography using petroleum ether, pentane or hexane).

The aromatic and flavorful precursor can be used with various components of smoking articles. For example, an exemplary cigarette is described, in U.S. Pat. No. 4,941,486 to Dube et al., the disclosure of which is herein incorporated by reference, and comprises a generally cylindrical rod of smokable material contained in circumscribing outer wrapping material to form a tobacco rod. The wrapping material can have the flavorful and aromatic precursor in intimate contact therewith. Typically, the wrapping material can include a conventional cigarette wrapping paper. Examples of wrapping material are the commercially available flax fiber and wood pulp/calcium carbonate filler papers; and the commercially available wrapping materials which contain inorganic oxides and/or hydroxides such as magnesium oxide and/or magnesium hydroxide. Suitable cigarette wrapping papers and cigarette rod configurations are set forth in U.S. Pat. No. 5,031,646 to Lippiello, et al. and commonly assigned U.S. patent application Ser. No. 07/661,747 filed Feb. 27, 1991, which are incorporated herein by reference.

The amount of the aromatic and flavorful precursor employed per cigarette can vary. Often, the amount of the precursor in intimate contact with the wrapping material of the tobacco rod ranges from about 0.1 mg to about 25 mg per cigarette, and frequently about 0.15 to about 5 mg per cigarette.

Typically, the amount of the precursor in intimate contact with the wrapping material of the tobacco rod is less than about 5 mg per cigarette, and usually is less than about 2.5 mg per cigarette.

Cigarettes can further include a filter element such as positioned adjacent to one end of rod such that the filter element is axially aligned with the rod in an end-to-end relation. An exemplary filter element is described in commonly assigned U.S. Ser. No. 07/621,499, filed Dec. 7, 1990, the disclosure of which is incorporated herein by reference. Filter elements have a substantially cylindrical shape, and the diameter of the rod is substantially equal to the diameter of the filter element. Preferably, the filter element abuts the rod. The ends of the filter element are open to permit the passage of air and smoke therethrough. The filter element comprises filter material which optionally is overwrapped with circumscribing wrap material. The filter material can be in intimate contact with the aromatic and flavorful precursor. Such a segment is referred to as a "smoke-altering filter segment." Normally, prior to smoking the cigarette, the smoke-altering filter segment includes at least about 0.1 percent of the aromatic and flavorful precursor, based on the weight of the filter material. The filter material can be a conventional cigarette filter material such as cellulose acetate, polypropylene, or the like; and the filter element can have a fibrous character, a molded shape, or other such configuration.

The aromatic and flavorful precursor can be used as casing and top dressing component for various smokable materials. The precursor also can be contacted with tobacco and employed as a form of tobacco in smoking article manufacture. For example, tobacco cut filler, as well as the types of smokable materials described in commonly assigned U.S. patent application Ser. No. 07/276,161, filed Nov. 23, 1988, the disclosure of which is incorporated herein by reference, can be coated or otherwise contacted with about 0.001 to about 1 percent by weight of the aromatic and flavorful precursor, based on the weight of the particular smokable material. Furthermore, the coated tobacco cut filler may be combined with aerosol forming materials, and employed in the manufacture of those smoking articles described in U.S. Pat. Nos. 4,708,151 to Shelar; 4,771,795 to White et al.; 4,714,082 to Banerjee et al.; 4,756,318 to Clearman et al.; and 4,793,365 to Sensabaugh et al., the disclosures of which are incorporated herein by reference, as well as European Patent Publication Nos. 212,234 and 277,519. In addition, the coated tobacco cut filler can be incorporated into those smoking articles described in commonly assigned U.S. patent application Ser. No. 07/414,833 filed Sep. 29, 1989 and European Patent Publication No. 280,990.

The aromatic and flavorful precursor can also be contacted with a substrate. Preferred substrates are normally solid materials and are thermally stable at those temperatures experienced during the heat treatment steps of the present invention. Examples of suitable substrate materials include porous carbons, carbon yarns, high surface area glass beads, aluminas, clays, and the like. Typically substrates are aluminas available as D-2 Sintered Alpha Allumina from W. R. Grace & Co. and carbon yarns available as Kynol Catalogue No. CFY-202Y-3 from American Kynol, Inc.

The aromatic and flavorful precursor is a composition which exhibits little or no flavor or aroma characteristics when present in contact with the wrapping material, tobacco material, filter element, or substrate prior to the time that the smoking article is smoked. Upon experiencing the temperatures of a burning smoking article, the aromatic and flavorful precursor undergoes a change in their nature to form a plurality of compounds that as a whole provide a characteristic aroma.

When the tobacco rod is burned during use of the smoking article, the aromatic and flavorful precursor undergoes a chemical rearrangement to yield compositions or products which exhibit an aroma which can be characterized as similar to that of the flavoring agent. The aroma provided by the rearrangement components is such that the characteristic sidestream cigarette smoke aroma is masked or overridden by those components. As such, the aromatic and flavorful precursor provides for a reduction in the negative attributes associated with the aroma of sidestream smoke. However, when drawn upon by the smoker, the smoking article yields mainstream smoke having a flavor which is not adversely affected by the presence of the aromatic and flavorful precursor rearrangement components. When smoked under standard FTC smoking conditions, significantly more of the rearrangement components are present in the sidestream smoke produced by the cigarette than in the mainstream smoke of the cigarette. FTC smoking conditions consist of a 35 cc puff volume of 2 second duration taken once very 60 seconds.

The following examples are provided in order to further illustrate preferred aspects of the invention but should not be construed as limiting the scope thereof. Unless otherwise noted, all parts and percentages are by weight.

EXAMPLE 1

Under a nitrogen atmosphere, 15.76 g (105.0 mmole) piperonal, 20.62 g (100.0 mmole) diethyl L-tartrate, 15.56 g (105.0 mmole) triethyl orthoformate and 12 mg of p-toluenesulfonic acid monohydrate are heated to 120° C. for 2.5 hours. A by-product containing ethanol is collected (13.85 g) over the range of 50°-78° C. The pot residue is cooled to room temperature, diluted with 200 ml dichloromethane, and washed with 50 ml saturated sodium bicarbonate solution. The dichloromethane layer was separated, washed with 10% sodium bisulfite solution (3×50 ml), and dried over anhydrous sodium sulfate. Filtration and concentration afforded 38.16 g of a light yellow oil. Vacuum distillation produced 29.38 g (86.8% yield) of the flavor nonglycosidic acetal precursor, diethyl 2,3-O-[3,4-(methylenedioxy)-benzylidene] L-tartrate, as a pale yellow oil with a boiling point of 177° C. at 0.25 mm Hg. The flavor and aroma precursor is recrystallized from petroleum ether-diethyl ether to yield an off-white powder with a melting point of 36° C. to 37° C. When the powder is heated in a test tube a vanilla/piperonal aroma is detected.

| | |
|---|---|
| IR (neat): | 2980m, 2910m, 1751s, 1508m, 1452s, 1257s, 1140s, 1105s, 1037s, 929m, 812m. |
| $^1$H NMR ($CDCl_3$, 300 MHz): | 1.30, 1.32 (2t, J = 7, 6H, 2 $C\underline{H}_3CH_2O$); 4.27, 4.29 (2q, J = 7, 4H, 2 $C\underline{H}_3C\underline{H}_2O$); 4.77, 4.88 (2d, J = 3, 2H, 2 H—C); 5.93 (s, 2H, $H_2C$—O); 6.02 (s, H—C—O); 7.00 (dd, J = 7, 1.5, 2H, Ar—H); 7.09 (d, J = 1.5, 1H, Ar—H). |
| MS: | 338 (M+), 265, 217, 166, 149, 93, 29. |

EXAMPLE 2

Under a nitrogen atmosphere, 13.88 (105.0 mmole) trans-cinnamaldehyde, 20.62 g (100.0 mmole) diethyl L-tartrate, 15.56 g (105.0 mmole) triethyl orthoformate and 13.8 mg of p-toluenesulfonic acid monohydrate are heated to 140° C. for 1 hour. A by-product containing ethanol is collected (15.07 g) over the range 50°-78° C. The pot residue is cooled to room temperature, diluted with 200 ml dichloromethane, and washed with saturated sodium bicarbonate solution (2×50 ml). The dichloromethane layer was separated, washed with 10% sodium bisulfite solution (3×50 ml), and dried over anhydrous sodium sulfate. Filtration and concentration afforded 37.94 g of a light yellow oil. Vacuum distillation produced 29.62 g (92.5% yield) of the flavor nonglycosidic acetal precursor, diethyl 2,3-O-cinnamylidene L-tartrate, as a pale yellow oil with a boiling point of 176° C. at 0.25 mm Hg which is subsequently crystallized as an off-white powder with a melting point of 50° to 52° C.

| | |
|---|---|
| IR (neat): | 2980m, 2900m, 1751s, 1728s, 1660m, 1454m, 1413m, 1375m, 1238s, 1217s, 1157s, 1043s, 954s, 854m, 750s, 694s. |
| $^1$H NMR ($CDCl_3$, 300 MHz): | 1.31, 1.32 (2t, J=7, 6H, 2 $CH_3C\underline{H}_2O$—) 4.27, 4.29 (2q, J = 7, 4H, 2 $CH_3C\underline{H}_2O$—); 4.74, 4.84 (2d, J = 7, 2H, 2H—C); 5.80 (d, J = 3, 1H, H—C—O); 6.22 (dd, J = 17, 7, 1H, ArC=C$\underline{H}$—); 6.82 (d, J = 17, 1H, ArC$\underline{H}$=C—); 7.24-7.44 (m, 5H, Ar—$\underline{H}$). |
| MS: | 320 (M+), 247, 217, 148, 115, 103, 29. |

EXAMPLE 3

Under a nitrogen atmosphere, 3.83 g (29.0 mmole) trans-cinnamaldehyde, 4.70 g (27.6 mmole) (1S,2S,3R,5S)-2,3-(+)-pinanediol, 4.30 g (29.0 mmole) triethyl orthoformate dehydrating agent and 7 mg p-toluenesulfonic acid catalyst are heated with stirring for 1.75 hours. An ethanolic by-product is distilled over the range of 75°-78° C. The pot residue is an amber oil which is cooled to room temperature, diluted with 80 ml dichloromethane and washed with 25 ml of saturated sodium bicarbonate solution. The dichloromethane layer is separated, washed with 10% sodium bisulfite solution (3×25 ml), and is dried over anhydrous sodium sulfate. Filtration and concentration provides 7.60 g of an amber oil. Vacuum distillation provides 2.60 g (33.1% yield) of a flavor nonglycosidic acetal precursor, trans-cinnamaldehyde 2,3-pinanediol acetal, as an almost colorless (faintly yellow) oil with a boiling point of 152° C. at 0.3 mmHg.

| | |
|---|---|
| IR (neat): | 3050w, 2970m, 2930s, 2762w, 1712m, 1637m, 1150s, 1040s, 966s, 748m, 692m. |
| $^1$H NMR ($CDCl_3$, 300 MHz): | 0.85 (s, 3H); 1.29 (s, 3H); 1.42 (s, 3H); 1.72 (d, J = 10, 1H); 1.88-2.26 (m, 6H); 4.02 (d, J = 7, 1H); 5.40 (dd, J = 6.4, 0.6, 1H, H—C—O(—O)); 6.23 (dd, J = 16, 6, PhC=CH—); 6.82 (d, J = 16, PhCH=C—); 7.20-7.45 (m, 5H, Ph—H). |
| MS: | 284 (M+), 240, 185, 135, 104, 93, 43. |

Cigarettes have lengths of 84 mm and circumferences of 24.75 mm. Each cigarette has a tobacco rod having a length of 63 mm and a filter element having a length of 21 mm. The tobacco rod includes a charge of tobacco cut filler contained in a circumscribing cigarette paper wrap. The tobacco cut filler has the form of an "American blend", and the paper wrap is available as Reference No. 856 from Kimberly-Clark Corp. The filter element was manufactured using conventional cigarette filter making technology from plasticized cellulose acetate tow circumscribed by paper plug wrap.

To the paper wrap of the tobacco rod is applied the aromatic and flavorful precursor, diethyl 2,3-O-[3,4-

(methylenedioxy)benzylidine] L-tartrate of Example 1. In particular, a 20 percent solution of the aromatic and flavorful precursor is prepared, and about 10 mg of the precursor is applied to the entire outer surface of the paper wrap of the tobacco using a syringe. The cigarettes so treated are air-dried.

Upon smoking the cigarettes, the resulting cigarette sidestream smoke exhibited an aroma which is more pleasant smelling than that sidestream smoke of a similar cigarette not having the aromatic and flavorful compound in intimate contact therewith. The flavor of the cigarette mainstream smoke is not adversely affected by the presence of the aromatic and flavorful compound in the paper wrap. The relatively low level of the compound present in the cigarette act to complement the flavor and aroma of the mainstream smoke, and does not provide an overpowering flavor or artificial taste (i.e., undesirable off-taste) to the mainstream cigarette smoke. Specifically, a sweet, spicy and slightly floral aroma is released upon pyrolysis.

EXAMPLE 5

Example 4 is repeated except 10 mg of the aromatic and flavorful precursor, 2,3-O-cinnamylidene L-tartrate of Example 2 is applied to the outer surface of the paper wrap. A sweet, spicy somewhat woody/floral aroma is released upon pyrolysis.

EXAMPLE 6

Example 4 is repeated except 10 mg of the aromatic and flavorful precursor, trans-cinnamaldehyde 2,3-pinanediol acetal of Example 3 is applied to the outer surface of the paper wrap. A sweet/spicy aroma and a woody/piney aroma are released upon pyrolysis.

That which is claimed is:

1. A cigarette comprising smokable material contained in circumscribing wrapping material, the wrapping material containing an aromatic and flavorful precursor formed by contacting 2,3-pinanediol with trans-cinnamaldehyde.

* * * * *